United States Patent [19]

Palmer et al.

[11] 4,365,458

[45] Dec. 28, 1982

[54] METHOD AND APPARATUS FOR FILLING SLEEVES WITH FINISHED DISC RECORDS AND INSERTING THE FILLED SLEEVES INTO JACKETS

[75] Inventors: Leonard Palmer; Jack A. Palmer, both of Morristown, N.J.

[73] Assignee: Lened, Inc., Elizabeth, N.J.

[21] Appl. No.: 167,097

[22] Filed: Jul. 9, 1980

[51] Int. Cl.[3] ..... B65B 43/28; B65B 43/36; B65B 55/04

[52] U.S. Cl. ..... 53/449; 53/459; 53/173; 53/573; 53/386

[58] Field of Search ..... 53/449, 459, 173, 170, 53/571, 573, 385, 386; 425/810

[56] References Cited

U.S. PATENT DOCUMENTS

| | | | |
|---|---|---|---|
| 3,934,388 | 1/1976 | Stadlbauer et al. | 53/571 X |
| 4,064,674 | 12/1977 | Palmer | 53/573 X |
| 4,149,356 | 4/1979 | Palmer | 53/459 |
| 4,300,331 | 11/1981 | Yoshiba | 53/573 |

FOREIGN PATENT DOCUMENTS

| | | | |
|---|---|---|---|
| 1269170 | 4/1972 | United Kingdom | 425/810 |

*Primary Examiner*—Horace M. Culver
*Attorney, Agent, or Firm*—Harold I. Kaplan; Roland A. Dexter

[57] ABSTRACT

A method and apparatus for placing, in sequence, a finished disc record into an empty sleeve, the record-filled sleeve into an empty jacket, and the filled jacket on a stack of finished products. Two vertically reciprocating releasable holding heads are supported above and in registry with two of three adjacent stacks in a row. A movable carriage located between the heads and the stacks translates along the row in a predetermined operational sequence. A finished disc record is pushed transversely to the stack row into an open, empty sleeve held above a stack of empty sleeves by the sleeve holding head. After release of the filled sleeve by the sleeve holding head, the carriage supports the filled sleeve, transports it transversely, and by a continuing carriage motion, inserts the filled sleeve, still supported by a portion of the carriage, into an empty, open jacket held above a stack of empty jackets by the jacket holding head. Then the carriage transports the filled jacket to the end position above a finished-product stack, whereupon the holding heads descend. The sleeve holding head raises an empty sleeve from the sleeve stack; and the jacket holding head raises an empty jacket from the jacket stack. The carriage translates toward the sleeve stack to initiate another cycle, while a stripper block engages the filled jacket which drops onto the stack of finished products. The apparatus is part of an integrated record-press system as well as an attachment used in connection with an existing record press.

34 Claims, 7 Drawing Figures

10
12
14
16
18
20
22
24
26
27
28
30
32
34
35
36
38
40
42
43
44
45
46
48
52
54
55
56
58
62
76
78
83
94
114
120
121
122
126
134
136
182
186
A
B
C

METHOD AND APPARATUS FOR FILLING SLEEVES WITH FINISHED DISC RECORDS AND INSERTING THE FILLED SLEEVES INTO JACKETS

BACKGROUND OF THE INVENTION

This invention relates generally to a method and apparatus for applying protective coverings on a finished disc record, and more particularly to a method and apparatus for placing finished disc records in sleeves, placing the filled sleeves in jackets and disposing the filled jackets in a stack of finished products.

As is well known, as soon as the manufacture of disc records is completed, the finished records must be individually placed in sleeves or envelopes of lightweight material such as paper. The filled sleeves are then arranged in a stack. Subsequent operations require that the filled envelopes be placed in semirigid jackets frequently composed of flexible cardboard. When these operations are performed manually, they are slow, inefficient and, consequently, expensive. Methods and apparatus as for enclosing the records within sleeves and arranging the envelopes within a stack have been developed, but many of these are relatively complex and expensive. Furthermore, it is still required that a certain amount of manual operation be performed in connection with the placing of finished records in sleeves and the stacking of the filled sleeves. U.S. Pat. No. 4,149,356 discloses a method and apparatus for inserting finished disc records into sleeves and subsequently stacking the sleeved records; however, there is no provision for enclosing the sleeved records in jackets, which are necessary for proper protection.

A further difficulty in accomplishing the protection of disc records results from a need for tailor-made equipment associated with each design of record press in order to efficiently and automatically enclose records derived therefrom.

What is needed is a method and apparatus which receives newly finished disc records from a record press and inserts them consecutively in sleeves and jackets and subsequently stores the finished product in a stack. It is also desirable that the apparatus be a part of an integrated record-press system or be used as an attachment in connection with an existing record press.

SUMMARY OF THE INVENTION

Generally speaking, in accordance with the invention, a method and apparatus especially suitable for the application of protective coverings and stacking of disc records is provided.

In sequence, finished disc records are placed into an empty sleeve, the record-filled sleeve is inserted into an empty jacket, and the filled jacket is placed on a stack of finished products. Vertically reciprocating holding heads are supported above and in registry with two of a row of three adjacent stacks. A movable carriage, located between the heads and the stacks, translates along the row in a predetermined operational sequence.

One end stack holds the finished products, i.e., record filled jackets. The opposite end stack holds empty sleeves, and the central stack holds empty jackets. A finished disc record is pushed transversely to the stack row from the record press and into an open, empty sleeve held above the stack of empty sleeves by the sleeve holding head. After release of the filled sleeve by the sleeve head, the carriage supports the filled sleeve, transports it transversely, and by continuing carriage motion, inserts the filled sleeve, still supported by a portion of the carriage, into an empty, open jacket held above the stack of empty jackets by the jacket holding head. Then the carriage transports the filled jacket to the end position above the finished-product stack, whereupon the two heads descend. The sleeve holding head raises an empty sleeve from the sleeve stack and the jacket holding head raises an empty jacket from the jacket stack. The carriage translates toward the sleeve stack to initiate another cycle, while a stripper engages the filled jacket, and causes the filled jacket to drop in free fall onto the stack of finished products.

An air jet and vacuum tube hold respectively the empty sleeve and empty jacket open prior to insertion to avoid interference between moving and stationary parts and malfunction of the apparatus. A vacuum holds the sleeved disc on the carriage during translation prior to insertion into a jacket. Similarly, a vacuum holds the completed product as it is transported by the carriage to the stack of finished products. Operation of the apparatus is synchronized to operation of the record press such that all output of the record press is accommodated without need for intermediate storage of finished discs.

The apparatus is part of an integrated record-press system as well as an attachment used in connection with an existing record press.

Accordingly, it is an object of this invention to provide an improved method and apparatus for enclosing a finished disc record in protective coverings automatically.

Another object of this invention is to provide an improved method and apparatus which places a finished disc record into a sleeve, places the filled sleeve into a jacket and stacks the finished product.

A further object of this invention is to provide an improved apparatus for sleeving, jacketing and stacking disc records which is compact, efficient and trouble-free.

Still another object of this invention is to provide an improved apparatus for covering disc records which may be integrated into a record-press system or be used in connection with existing record-press systems.

Still other objects and advantages of the invention will in part be obvious and will in part be apparent from the specification.

The invention accordingly comprises the several steps and the relation of one or more of such steps with respect to each of the others, and the apparatus embodying features of construction, combination of elements and arrangement of parts which are adapted to effect such steps, all as exemplified in the following detailed disclosure, and the scope of the invention will be indicated in the claims.

BRIEF DESCRIPTION OF THE DRAWINGS

For a fuller understanding of the invention, reference is had to the following description taken in connection with the accompanying drawings, in which.

DESCRIPTION OF THE PREFERRED EMBODIMENTS

Figure 1:
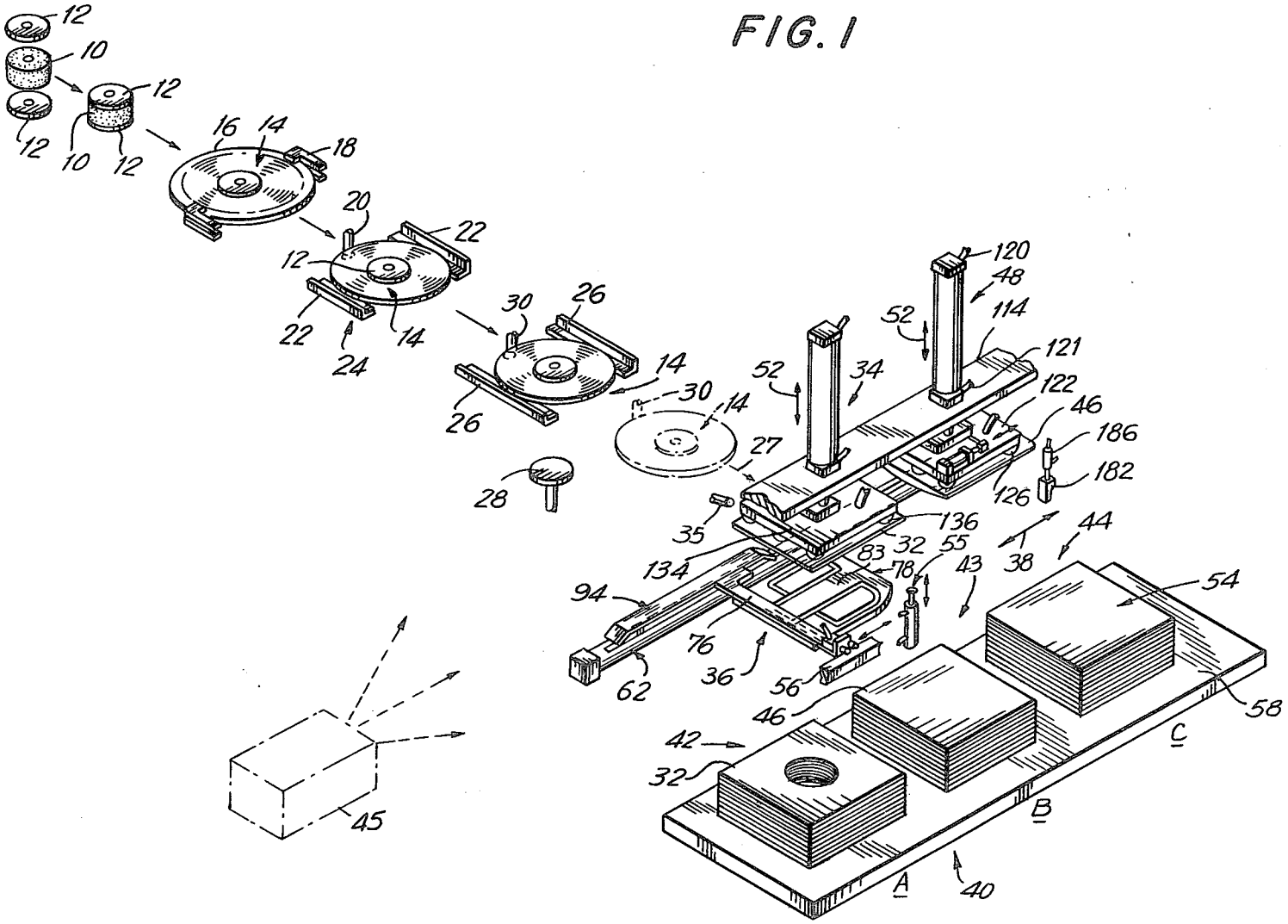
FIG. 1 is a semi-schematic representation in perspective of a record-manufacturing machine and the structure and method of the present invention utilized therewith for sleeving, jacketing and stacking finished record discs.
Figure 2:
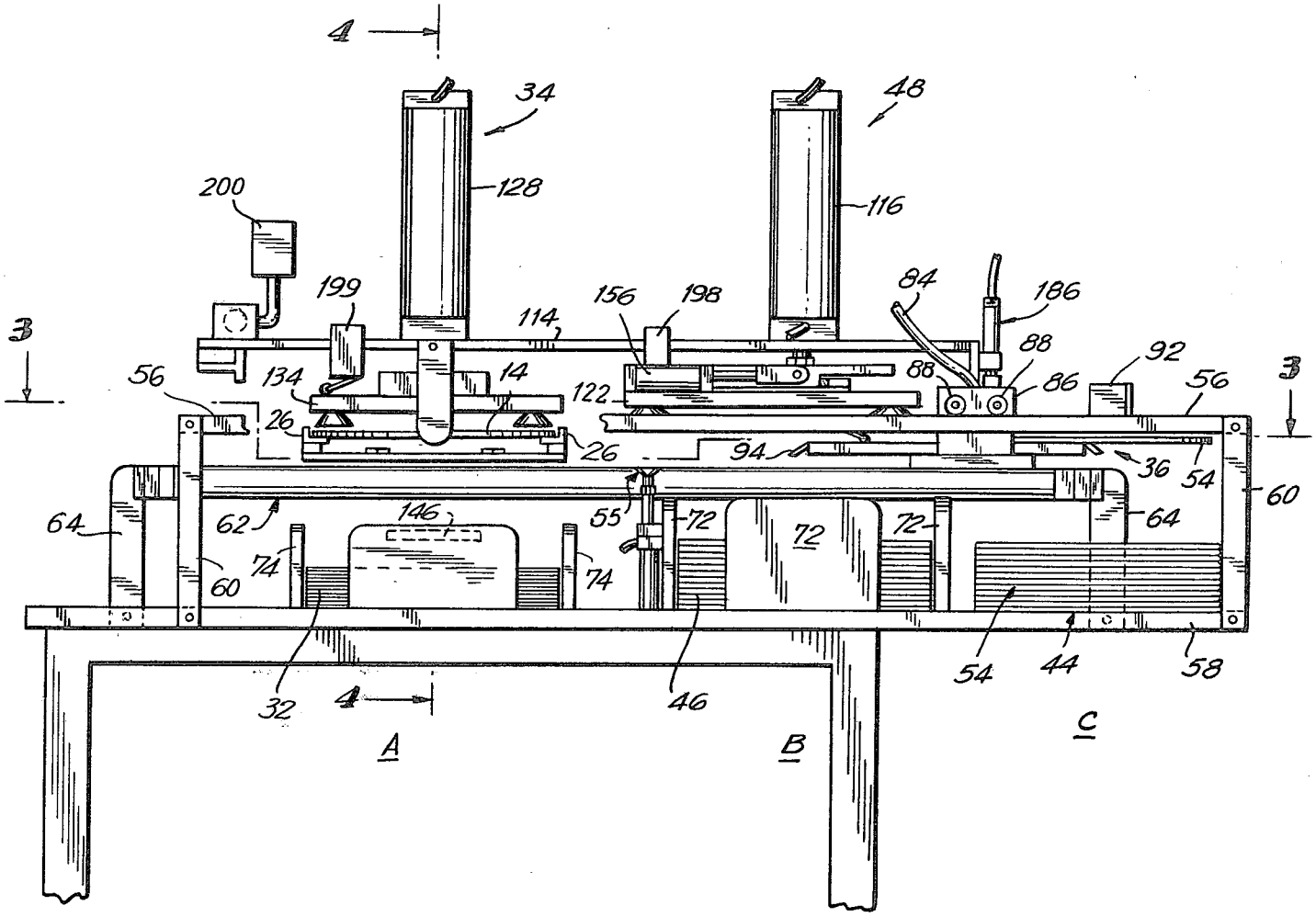
FIG. 2 is a front elevational view with parts omitted of the sleeving, jacketing and stacking apparatus for disc records of this invention.

With reference to FIG. 1, there is schematically represented a cake 10 from which a disc record is subsequently formed, labels 12 being shown above and below the cake 10. Labels 12 are placed in engagement with the upper and lower surfaces of cake 10, whereupon this assembly is pressed in a known record press (not shown) to form a disc record 14 which has a peripheral flash 16 which must be removed therefrom. This flash is engaged in a known way by a pair of fingers 18 which transport the record 14 to a location where the flash 16 is removed, whereupon the finished record 14 is pushed by a suitable pin 20 along guides 22 to a location 24 indicated in FIG. 1. The finished record 14 at the location 24 is then raised by means of a supporting circular plate 28 and deposited on a pair of record guide-rails 26 when the circular plate 28 is lowered.

After a record 14 is thus situated on the rails 26, it is engaged by a pusher means which includes the schematically illustrated pusher pin 30 (FIG. 1), and this pusher pin 30 is advanced together with the record 14 along a substantially straight path, as indicated by the arrow 27. At the termination of this predetermined substantially straight path of movement of the record 14, there is an open envelope or sleeve 32 held at that position by a releasable sleeve holding head 34. The structure and method are such that the pin 30 pushes the finished record 14 into the sleeve 32. The sleeve 32 is maintained in its open position by a stream of air delivered to the interior of the sleeve 32 by a blower jet 35.

The sleeve 32 is held by the holding head 34 in the path of movement of the disc record 14 by a vacuum-induced force, commonly known as suction, applied by the releasable holding head 34 to the top surface of the sleeve 32. Once the finished record 14 is situated in the sleeve 32, the vacuum force is terminated so that the sleeve 32, with the record 14 therein, can drop freely of its own weight.

All of the structure for transporting the finished disc record 14 from the record press until the record's release from the holding head 34, enclosed in the sleeve 32, is conventional and forms no novel part of the present invention. Such a structure is disclosed in my U.S. Pat. No. 4,149,356, cited above. At this moment, a carriage 36 is situated beneath the releasable sleeve holding head 34 so that the filled sleeve 32, released from the head 34, falls onto a supporting surface of the carriage 36, as explained more fully hereinafter. The carriage 36 is movable in both directions, as indicated by a double-headed arrow 38, transversely to path 27 of the finished disc record 14.

A support platform 40 of extended length, oriented parallel to the transverse path 38, supports three stacks, 42–44, at three stations, A, B, C respectively. The end stack 42 at station A is located directly beneath and in alignment with the sleeve holding head 34.

The end stack 42 is comprised of empty envelopes or sleeves 32, and stack 43, at station B, is comprised of empty jackets 46 used for enclosing a disc record 14 which has previously been inserted in a sleeve 32.

The stack 44, at station C, is comprised of the finished product 54, namely, disc records 14 enclosed in sleeves 32 and further enclosed in jackets 46.

A releasable jacket holding head 48 similar in construction to the sleeve holding head 34 and capable of applying a similar vacuum force, is positioned above the stack 43 at station B. The holding heads 34, 48 are aligned to the carriage path 38 and spaced above the support platform 40 with the stacks 42–44 located thereon. Each holding head produces a reciprocating vertical motion as indicated by the arrows 52.

After the record 14, enclosed in a sleeve 32 and dropped from the holding head 34 is received on the support surface 83 of the carriage 36, the carriage 36 translates from station A to station B, and by this motion, the sleeved record is inserted into the open end of a jacket 46 held by the head 48 and the vacuum force applied thereby.

The vacuum or suction force applied by the head 48 is released, and the record 14, now enclosed in a sleeve 32 and further enclosed in a jacket 46, is translated by the movable carriage 36 to the station C, where it is positioned over the finished-product stack 44.

Then, the sleeve head 34 over station A, which at this moment is supporting no object, descends to grip by vacuum an empty sleeve 32 from the stack 42 of sleeves and raise the sleeve 32. Substantially simultaneously, the jacket holding head 48 descends over station B to grip by means of a suction force an empty jacket 46 and raise it from the stack 43. A stripper block engages the filled jacket, preventing jacket motion while the carriage withdraws and translates to the position over the sleeve stack. The packaged record falls freely onto the stack of finished product.

Thus, the condition shown in FIG. 1 is produced, with the two holding heads 34, 48, elevated and supporting an object 32, 46, respectively, by means of a suction or vacuum force. The sleeve 32 is held open at the end facing the oncoming record disc 14 by means for an air jet 35, and the jacket 46 is held open by a suction tube 55 to intercept and receive therein a sleeved record disc borne by the carriage 36. The empty carriage 36 is again located at station A, and the entire cycle repeats for each record disc 14 produced by the record-press apparatus and advanced along the path indicated by the arrow 27.

Periodically, a work person manually removes the finished product 54 from the stack 44 and adds empty sleeves 32 and empty jackets 46 to the respective stacks 42, 43. A precise interrelation in timing between the holding heads at the stations is not required except that certain conditions must be met, as will be apparent from the description of operations presented above. In particular, the carriage 36 translates clear of the space above station A before the sleeve holding head 34 descends for the next empty sleeve 32. Further, the carriage 36 bearing a sleeved record does not arrive over the central stack 43 until the holding head 48 has raised an empty jacket 46. The carriage 36 delivers the sleeved recording at a suitable elevation for insertion in the empty jacket 46, and the vacuum tube 55 (FIGS. 1, 2, 5 and 7) associated with the stack 43 of jackets 46 maintains the end of the elevated jacket 46 in an open condition. The holding heads 34, 48 do not descend to raise another sleeve 32 and jacket 46, respectively, until the carriage 36 has translated toward station C and cleared the air space between the holding heads 34, 48 and the stacks 42, 43 beneath. Accordingly, substantially simultaneous descent of the holding heads 34, 48 substantially simultaneous elevation of the holding heads, each bearing a load by means of a suction force, and sequential release of the suction force beginning at station A and progressing to stations B and C provides a sequence of operation which has performed satisfactorily. The carriage 36 moves in a continuous sweep from station A to station C and from station C to station A, but a sequence including a stop at station B is also satisfactory in performance.

As explained more fully hereinafter, clamping by vacuum of the semifinished and finished product 54 in the carriage 36 during translation is provided.

A control system 45, indicated schematically in FIG. 1, comprises controls for the timing and implementation of events and may include conventional elements and sensors located at different points in the equipment, some components not being included in the Figures, for example, valves (not shown) for actuating gas-operated cyclinders and pistons, some sensors to detect the presence of the carriage 36 at certain positions, to detect elevation of the holding heads, to indicate the presence of a disc record 14 ready for insertion, etc. The particular structure of the control system 45 is conventional and not a novel part of this invention. Accordingly, the control system 45 warrants and receives no greater recital of descriptive detail than is already provided herein.

Figure 7:
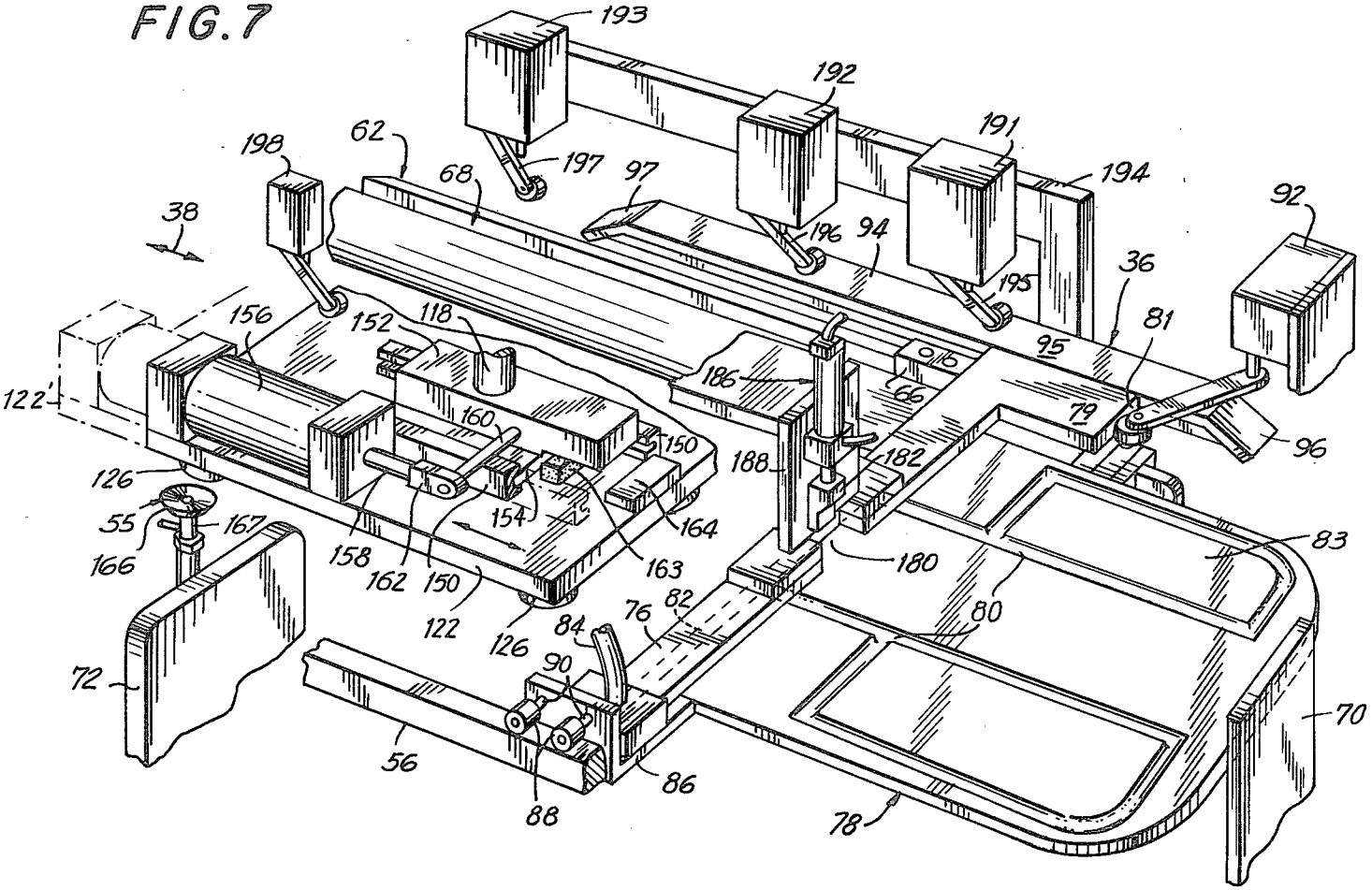
FIG. 7 is a fragmented perspective view with parts omitted showing the carriage and jacket holding head of FIG. 1.

A more detailed description of the construction of the apparatus of this invention follows. The support platform 40 includes an elevated rail 56 supported above a base plate 58 by end post 60. Linear actuator 62 on the opposite side of the base plate 58 runs parallel to the rail 56 and is elevated above the base plate 58 by means of vertical supports 64. As best seen in FIG. 7, a driver block 66 extends from a slot 68 at the top of the linear actuator 62. The block 66 is driven by the linear actuator mechanism (not shown) and travels the length of the slot 68 on command of the controller 45 as discussed more fully hereinafter. The carriage 36 is fixedly attached to and translates with the driver block 66.

Figure 6:
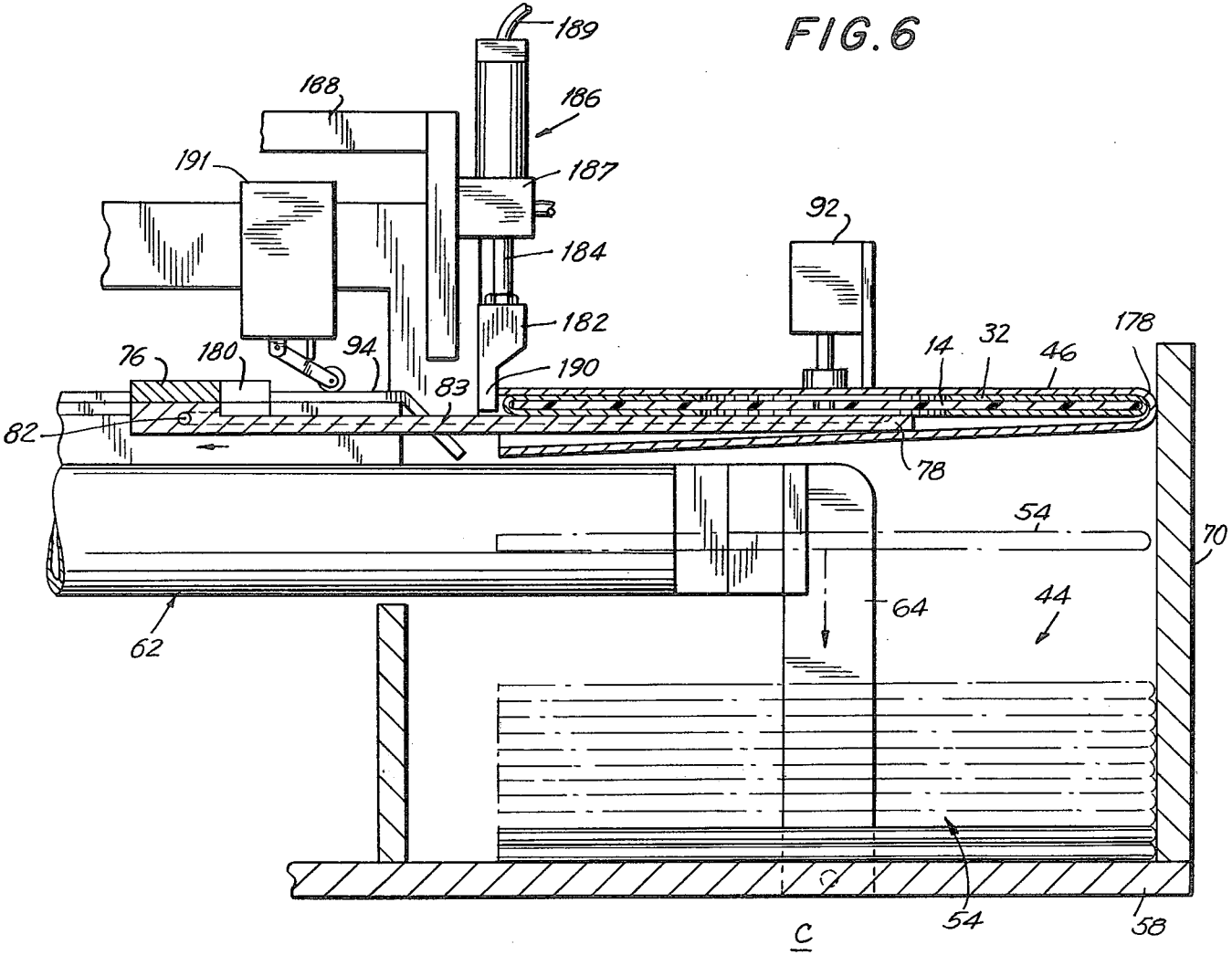
FIG. 6 is a view taken along line 6—6 of FIG. 3.

The stack 44 of finished product 54 rests on the base plate 58 and as best seen in FIGS. 6 and 7 is contrained by a vertical stopper plate 70 afixed to the base plate 58 in a position transverse to the direction of motion 38 of the carriage 36.

The jackets 46 in the stack 43 are contrained on the four edges by vertical plates 72 and the sleeves 32 are constrained in the stack 42 along the four edges by vertical plates 74. The plates 72, 74 are fixedly attached to the base plate 58.

The carriage 36 includes a crossmember 76 fixedly connected to a tray 78 having a generally planar upper support surface 83. Channels 80 cut into the surface 83 of the tray 78 are connected to a duct 82 in the crossmember 76 connected to a vacuum line 84. An angle 86 connects to the tray 78 and crossmember 76 and includes a pair of rollers having their shafts 90 fixed in the vertical flange of the angle 86 such that the rollers 88 roll along the upper surface of the rail 56.

The other side of the carriage 36 attaches to the driver block of the linear actuator 62 by a fixed attachment of the crossmember 76 to the driver block 66. As best seen in FIG. 7, the crossmember 76 is L-shaped, having a base 79 extending toward the stopper plate 70. The leading edge 81 of the base 79 actuates an end-of-travel switch 92 described more fully hereinafter. A ramped cam 94 connects to the crossmember 76 adjacent the base 79 and includes a horizontal cam surface 95 and a downwardly sloping surface 96 at the leading edge and a similar downwardly sloping surface 97 at the trailing edge. The cam engages and actuates various switches, as explained more fully hereinafter, as the carriage 36 translates in the directions indicated by the arrow 38. It should be understood that when a sleeve record disc 14, 32, rests on the tray 78, a vacuum is drawn through the line 84 to evacuate the channel 80 and draw the sleeve 32 down against the upper support surface 83 of the tray 78. Thus, the sleeved record is firmly held on the carriage 36 as the carriage translates from station to station.

The releasable holding heads 34, 48 are mounted to a bridge member 114 which is fixedly positioned, by means not shown, above the support platform 40 which, as discussed above, includes the elevated rail 56, vertical plates 72, 74, base plate 58, etc. The jacket holding head 48 is positioned at station B and includes a double-acting piston and cylinder 116 mounted vertically to the bridge 114 and having its shaft 118 extending through an opening 119 (FIG. 5) in the bridge 114. In the known manner, compressed gas, for example, air, can be introduced on either side of the piston through tubing 120, 121. Application of gas pressure to the piston through tubing 120 drives the shaft 118 downward, and release of the pressure on the tubing 120 and the application of said pressurized gas to the tubing 121 raises the shaft 118 to its original position. A hollow plate 122 is translatably connected to the lower end of the shaft 118, and the hollow interior of the plate 122 communicates with a source of vacuum (not shown) through a tubing 124. A plurality of suction cups 126 attached to the bottom wall of the hollow plate 122 have their interiors communicating with the interior of the plate 122, so that the vacuum within the plate 122 is communicated to the suction cups 126. A valve (not shown) connected to the tubing 124 controls the application of vacuum to the suction cups 126 such that when the holding head 48 descends upon the stack 43, which is holding empty jackets 46, the vacuum is applied and the suction cups 126 grip the jacket 46. Then gas pressure is applied to the tubing 121 to withdraw the shaft 118, raising the hollow plate 122 and the jacket 46. After the carriage 36 has translated from station A to station B, and has fully inserted a sleeved record disc into the suspended jacket 46, the vacuum applied through the tubing 124 is released and the suction cups 126 release the finished product 54.

A pair of opposed channels 150 are fixedly attached to the top surface of the hollow plate 122 and oriented in the direction of carriage travel 38. The shaft 118 connects to a boss 152 which has flat rails 154 extending laterally from both sides and engaging the grooves in the channels 150. A compressed gas operated piston in a cylinder 156 is also fixedly mounted to the top surface of the hollow plate 122 with its shaft 158 connected to the boss 152 by means of a drive rod 160 connected to a fitting 162 attached to the end of the piston shaft 158. Actuation of the piston and cylinder 156 such that the shaft 158 is further extended from the cylinder, causes the hollow plate 122 to translate to the position shown with the broken lines of FIG. 7 and indicated as 122'. Opposed stops 163, 164 on the boss 152 and hollow plate 122 respectively limit the travel of the hollow plate 122 when the shaft 158 is extended from the piston and cylinder assembly 156. When the piston and cylinder assembly 156 is actuated to withdraw the shaft 158 into the cylinder, the hollow plate 122 returns to the position indicated in the solid lines of FIG. 7.

The suction tube 55 comprised of a suction cup 166 attached to a shaft 167 extends vertically from the baseplate 58. The shaft 167 is connected to the piston (not shown) of a piston and cylinder assembly 168 which is connected to the vertical plate 72 closest to station A.

When the hollow plate 122 rises from the position shown in broken lines (FIG. 5) with a jacket 46 held by the suction cups 126, the hollow plate 122 is then translated to the left (FIG. 5) to the position shown in the solid lines. At that time, pressure is applied to the piston and cylinder assembly 168 through the tubing 169 causing the suction cup 166 to rise and contact the lower side of the suspended jacket 46. The suction cup 166 attaches to the jacket 46 as a result of a vacuum in the cup 166 applied through a tube 170. Release of the gas pressure on the tubing 169 and application of the gas pressure to the tubing 171 causes the suction cup 166 and shaft 167 to be drawn toward the piston and cylinder assembly 168, whereby the lower side of the jacket 46 is drawn down and the entrance 172 to the jacket 46 is open and held in that condition so long as the vacuum is applied to the tube 170.

Figure 5:
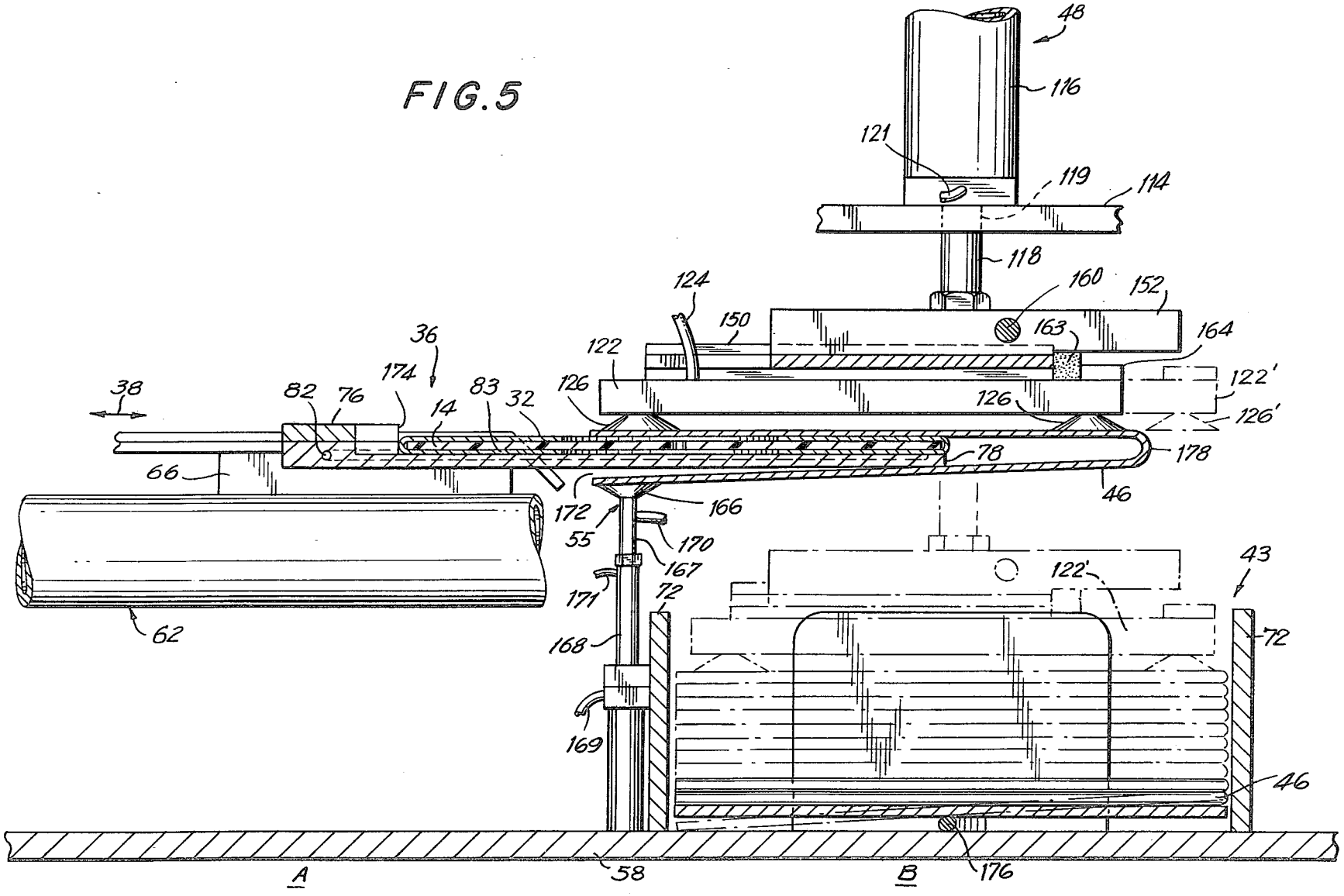
FIG. 5 is a view taken along line 5—5 of FIG. 3.

It should be noted that hollow plate lifts an empty jacket 46 from the stack 43 and raises it while the hollow plate 122 is the right-most position (FIG. 5) indicated by the broken lines. Therefore, the jacket 46 suspended from the suction cups 126 is clear of the suction cup 166 and entire suction tube assembly 55 as it rises. Only after the hollow plate 122 has translated to the left, that is, to the position shown in the solid lines of FIG. 5, is the suction cup 166 able to rise and engage the jacket 46.

The carriage 36 bearing a sleeved record on its upper surface 83 inserts the sleeved record into the open entrance 172 of the jacket. The tray 78 and the record disc 14 in the sleeve 32 enter the jacket 46 together being urged inwardly by a vertical surface 174 on the crossmember 76 of the carriage 36.

A rod 176 is fixed to the base 58 oriented transversely to the direction of the carriage motion 38. If there is any unevenness in the stack 43 of jackets 46, for example, due to the fact that at the closed end of the jacket 46, there is frequently a doubling of material and a thickening of the jacket, the suction cups 126 on the jacket holding head 48 might not fully engage the top surface of the jacket 46 for purposes of lifting. However, the presence of the rod 176 causes the stack 43 of jackets 46 to tilt as the hollow plate 122 and suction cups 126 descend and make contact, such that the top surface of the top jacket 46 in the stack 43 is horizontal and every suction cup 126 on the hollow plate 122 grips the jacket.

Figure 4:
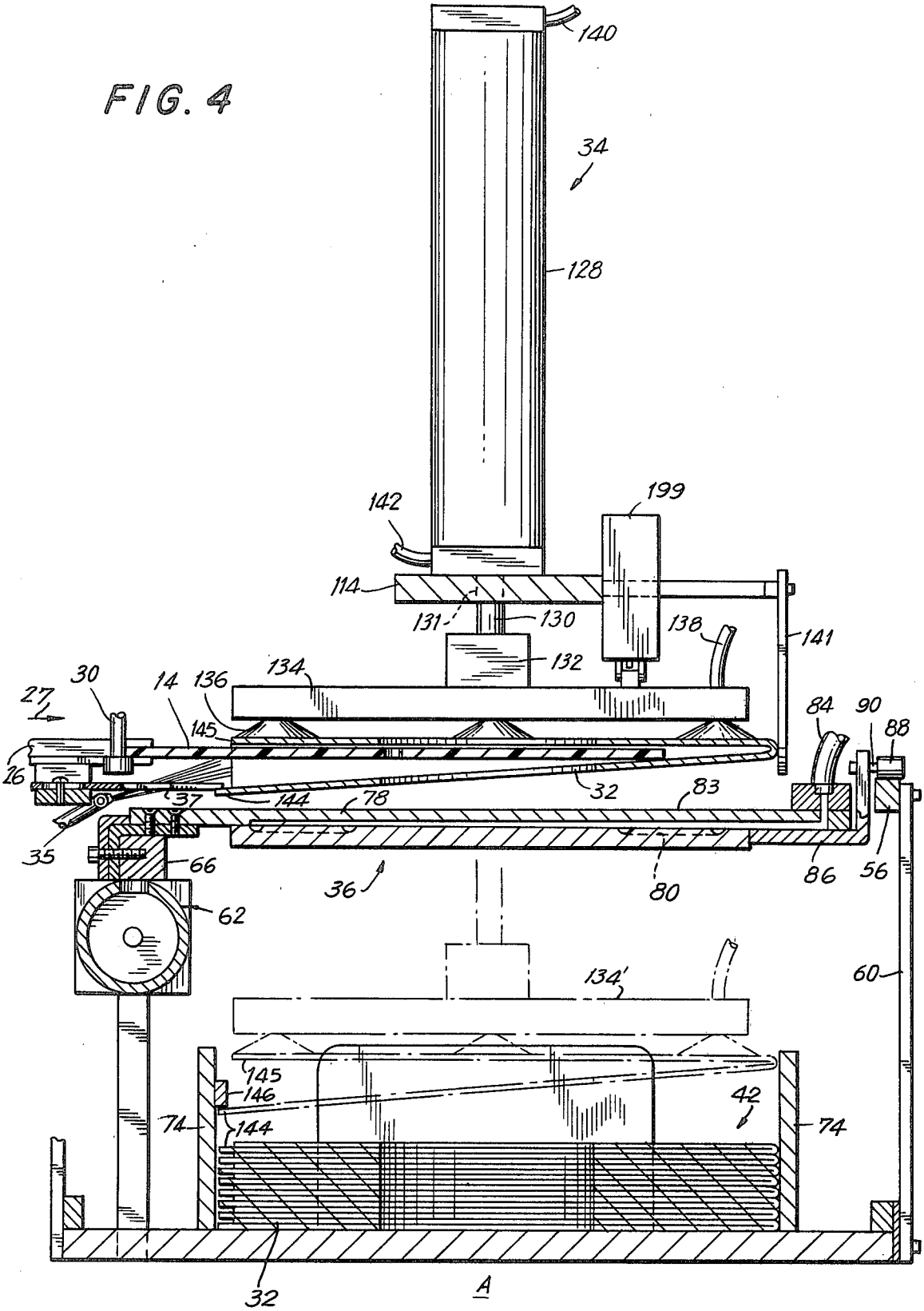
FIG. 4 is a view generally taken along line 4—4 of FIG. 2.

The releasable sleeve holding head 34 at station A includes the vertically oriented double-acting piston and cylinder assembly 128 fixedly attached to the bridge 114. A shaft 130 connected to the piston (not shown) in the assembly 128 passes through an opening 131 in the bridge 114 and is fixedly connected at its end to a boss 132, in turn fixed to a hollow plate 134. As described above in relation to the jacket holding head 48, the interiors of suction cups 136 attached to the plate 134 communicate with the hollow interior of the plate 134. A vacuum applied to the plate 134 through a tubing 138 is communicated to the suction cups 136. When gas pressure is applied to the piston and cylinder assembly 128 through a tube 140, the shaft 130 is extended and the hollow plate 134 and suction cups 136 descend to the stack 42 of empty sleeves 32, and the application of a vacuum via the tubing 138 causes attachment of the topmost envelope 32 in the stack 42 to the suction cups 136. Release of gas pressure on the tubing 140 and application of gas pressure at the lower tubing 142, in the known manner, cause the shaft 130 to withdraw, raising the envelope 32 from the stack 43, as best seen in FIG. 4.

It should be noted that the sleeve 32 in its stacked condition has a lower lip 144 protruding slightly beyond the upper edge 145 of the sleeve's open end. As the envelope 32 (FIG. 4) is raised from the stack 42, a fixed index bar 146, attached to a vertical plate 74, and located in the path of the upmoving sleeve 32 engages the protruding lower lip 144 while allowing the upper edge 145 to pass without contact. Thereby, the sleeve 32 is opened with the upper edge 145 separated from the lower lip 144, and an air jet 35 directs a stream of air to the interior of the sleeve 32 to maintain its opened condition such that the record disc 14 is easily inserted in the sleeve 32 without interference when the pusher pin 30 advances in the direction of the arrow 27. After the record disc 14 is completely inserted in the sleeve 32, the vacuum applied via the tube 138 is released and the sleeved record drops of its own weight onto the horizontal surface 83 of the carriage 36.

The carriage 36, bearing the record disc 14 within both a sleeve 32 and jacket 46, moves to the station C where the end 178 of the jacket 46 abuts the vertical stopper plate 70. Motion of the carriage 36 is stopped at this position with the sleeved and jacketed record disc 14 supported over the stack 44 of finished product 54. The stopper plate 70 not only aligns the supported record disc 14 with the finished product 54 but also assures that the sleeved record disc is fully inserted into the jacket 46.

At this position of the carriage 36, a notch 180 in the crossmember 76 is directly below a pick 182 or stripper which is mounted to a shaft 184 of a piston and cylinder assembly 186. The piston and cylinder assembly 186 is attached to a boss 187 which in turn is attached to a rigid superstructure 188 having a fixed relationship to the base 58. When the carriage is at station C (FIG. 6) and gas pressure is applied to the piston and cylinder assembly 186 by way of a tube 189, the shaft 184 extends from the piston and cylinder assembly 186 such that the lower end 190 of the pick 182 enters the notch 180 in the crossmember 76 and stops adjacent to the upper surface 83 of the tray 78.

When the carriage 36 and tray 78 are withdrawn toward station A, and the pick 182 is in its depressed condition (FIG. 6), the lower end of the pick engages with the upper side of the jacket 46 and prevents the sleeved and jacketed disc record 14 from moving with the carriage. Thus, the packaged disc record 14 is stripped from the tray 78 and falls freely onto the stack 44 of finished product 54. The empty carriage 36 continues to station A so that the procedure may be repeated.

Figure 3:
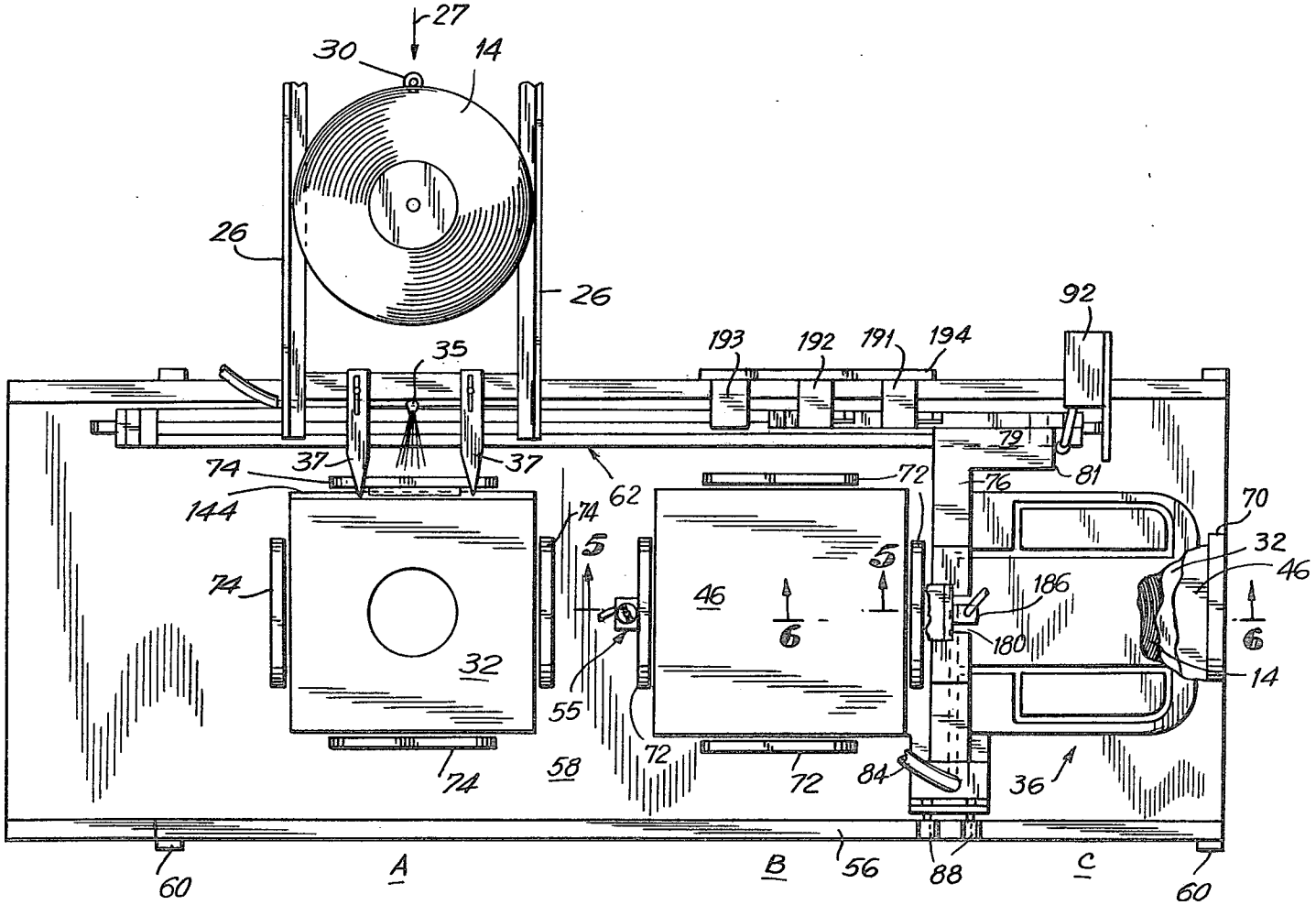
FIG. 3 is a top view of the apparatus of FIG. 2.

Switches 191, 192, 193 are mounted to additional superstructure 194 which is rigidly attached to the baseplate 58 in any convenient manner (not shown). The contacts of the switches 191–193 are opened and closed by actuation of the switch levers 195–197 respectively by the ramped cam 94 as it travels between the stations in the directions indicated by the double headed arrow 38. The sloped surfaces 96–97 at the leading and trailing edges of the cam 94 interact smoothly with the rollers provided at the end of the switch levers 195–197. Similar switches 198, 199 detect that the hollow plates 122, 134 respectively are in the fully elevated position. It should be noted that although in FIG. 2 the carriage 36 is located at station C, in FIG. 4 the carriage is indicated in cross section as though it was located at station A. Similarly, in FIG. 5 the carriage is indicated in cross section approaching station B whereas in FIG. 3 the carriage 36 is shown at station C. It is believed that these drawing arrangements lend clarity to the specification and the operation of the apparatus.

An operational cycle of the apparatus in accordance with this invention is now described. For the sake of an example, the conditions presented in FIG. 1 are used as a starting point of the cycle. The sleeve holding head 34 is holding an empty sleeve 32 by means of the suction cups 136 and the jacket holding head 48 is holding an empty jacket 46 by means of the suction cups 126. The sleeve opening is held open by means of the protruding fingers 37 attached to the guiderails of the record press apparatus (FIG. 4). The inlet 172 to the jacket 46 held by the suction cups 126 is maintained opened by means of the suction cup 166 pulling on the lower surface of the jacket 46.

Next, the record press pusher pin 30 moves a disc record 14 in the direction 27 such that the record disc 14 enters the empty sleeve 32 (FIG. 4). A stop 141 attached to the bridge 114 prevents the sleeve 32 from sliding in the grip of the suction cups 136 and limits the travel of the disc record 14 such that it is fully inserted into the sleeve 32.

At the end of the stroke of the pusher pin 30, a switch (not shown) is tripped, momentarily cutting off the vacuum in the hollow plate 134, allowing the sleeve 32, now containing the disc record 14, to drop of its own weight onto the upper surface 83 of the carriage 36. A vacuum in the channels 80 of the tray 78 holds the sleeved record disc on the carriage 36. Full return of the pusher pin 30 to its starting position trips a switch (not shown) which sets the carriage in motion toward station B.

At station B, an empty jacket 46 is held by the hollow plate 122 and suction cups 126 with the shaft 158 (FIG. 7) extended from the piston and cylinder 156 such that the hollow plate is at the position indicated by the broken lines 122'. As shown in FIG. 5, the pressure has been applied by way of the tubing 169 such that the suction cup 166 has contacted the lower side of the empty jacket 46. With a vacuum on the tube 170, the shaft 167 is withdrawn into the piston and cylinder assembly 168 and the entrance 172 to the jacket 46 is open as seen in FIG. 5.

As the carriage 36 moves from station A to station B the tray 78 with the sleeved record disc on its upper surface 83 is inserted into the jacket 46. As stated above, motion for the carriage is provided by the linear actuator 62 and the driver block 64 which connects the carriage 36 to the actuator 62. It should be noted that a linear actuator which has performed satisfactorily in the apparatus in accordance with this invention is comprised of a double-acting air driven piston in a cylinder. When a record disc 14 in its sleeve 32 and the tray 78 are fully into the jacket 46, the switch 193, actuated by the cam 94 operates through the control system 45 to cut off the vacuum in the vacuum plate 122 and in the suction cup 166 beneath the jacket 46. Thus, a sleeved jacketed disc record 14 is supported only by the tray 78 which is beneath the sleeve 32 and within the jacket 46.

In the continuing motion towards station C, the cam 94 actuates the switch 192 causing the piston and cylinder assembly 156 to draw the shaft 158 inwardly and move the hollow plate 122 to the position shown with solid lines in FIG. 7. Thus, the hollow plate 122 is clear of the suction tube assembly 55 and is able to descend without interference to pick up another jacket from the stack 43 of jackets 46.

The carriage 36 continues to station C and in the process the cam 94 actuates the switch 191 which causes the vacuum in the channels 80 of the tray 78 to be removed. Travel of the carriage 36 carries the jacketed and sleeved disc record 14 to the position shown in FIG. 6 with the end 178 of the jacket against the vertical stopper plate 70. In this position, the switch 92 is actuated by contact with the leading edge 81 of the base 79 on the crossmember 76.

Actuation of the switch 92 by the carriage 36, causes pressure to be applied to the holding heads 34, 48, such that both hollow plates 122, 134 descend and with vacuum applied to the suction cups 126, 136 attached to the upper one of the jackets 46 and sleeves 32 respectively in the stacks 43, 42 directly below. A vacuum switch 200 mounted on bridge member 114 detects that proper attachment has been made between the jackets and sleeves and the holding head hollow plates. Closing of the vacuum switch 200, indicating a good attachment, causes the hollow plates 122, 134 to rise with a jacket 46 and sleeve 32 respectively attached. As the hollow plate 134 rises, the lower lip 144 of the attached sleeve 32 engages the index bar 146 (FIG. 4) such that the sleeve is held open and in the fully elevated position the protruding fingers 37 (FIG. 3) and the air jet 35 maintain the sleeve 32 in an open condition so as to subsequently receive the disc record 14 therein as described above.

Limit switches 198, 199 detect that the holding heads are in their elevated positions and through the control system 45 initiate the motion of the carriage 36 from station C toward station A. Only when the holding heads are in their elevated positions is it possible for the carriage 36 to pass without interference.

Before the carriage can move from station C towards station A, the piston cylinder assembly 186 is actuated such that the shaft 184 is extended and the lower end 190 of the pick 182 enters the notch 180 in the crossmember 76 of the carriage 36. As best seen in FIG. 6, the lower end 190 of the pick 182 obstructs the upper side of the jacket 46 and the sleeved disc record 14 so that neither the sleeved record 14, 32 nor the jacket 46 can move with the carriage 36 in the direction to station A. Accordingly, the tray 78 is withdrawn from the filled jacket 46 and the finished product falls upon the stack 44 of finished product 54 directly below.

When the switch 191 is released from the cam 94, the vacuum is again applied to the channels 80 in the tray 78 of the carriage 36. As the switch 192 disengages from the cam 94 as the carriage 36 moves closer to station A, the piston and cylinder assembly 156 is actuated to extend the shaft 158 and move the hollow plate 122 to the position indicated by the broken lines 122' in FIG. 7 such that the jacket 46 held by the suction cups is again in position to be engaged by the suction tube 55 with its suction cup 166.

The carriage 36 returns to position A and the cycle is ready to repeat. The switch 193 is not actuated by return of the carriage 36.

Although in the embodiment of FIG. 1, etc., the stations are arranged in A, B, C order, it should be understood that in alternative embodiments of this invention, other arrangements of the stacks are possible, for example, B, C, A and B, A, C. These embodiments are made operative by changes in timing in raising and lowering of the releasable holding heads and in the movements of the carriages. Also, the crossmember 76 on the carriage 36 may be on the other end of the carriage. Such alternative arrangements are within the scope of this invention and could be implemented by one of ordinary skill in the art in view of the description above.

Further, although the embodiment described above has the three stations A, B, C in a linear arrangement, an arcuate arrangement of the stations and the releasable heads above them may be used in an alternative embodiment. In such an alternative embodiment, the carriage 36 travels in a corresponding arcuate path driven not directly by a linear actuator but rather by an oscillating arm driven, for example, by a rotating motor in cooperation with a linkage or cam mechanism. In such an apparatus, the motor may operate continuously, giving the carriage continuous motion between stations A and C, with short dwell periods at both end stations A and C before reversal in the direction of motion of the carriage. The motor may have variable speed control, whereby operation of the carriage 36 is precisely synchronized to any rate of production of disc records 14 and delivery at station A.

It will thus be seen that the objects set forth above, among those made apparent from the preceding description, are efficiently attained, and since certain changes may be made in carrying out the above method and in the construction set forth without departing from the spirit and scope of the invention, it is intended that all matter contained in the above description and shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. A method for enclosing finished disc records in sleeves individually, and the record-filled sleeves in jackets individually, and arranging the jackets with the finished records therein in a stack, comprising the steps of:

(a) pushing a finished record disc along a first path;
(b) raising an empty sleeve from a stack of empty sleeves to the level of said first path;
(c) opening said raised sleeve and receiving therein said pushed record;
(d) moving said record-filled sleeve along a second path from a position above said stack of empty sleeves to a position above a stack of empty jackets;
(e) raising an empty jacket from said stack of empty jackets, opening the end of said raised jacket and subsequently inserting therein said record-filled sleeve;
(f) transporting said jacket filled with said record-filled sleeve from said position above said stack of empty jackets to a position above a stack of record-filled jackets; and,
(g) depositing said jacket with said sleeved record therein onto a stack of similarly filled jackets.

2. A method as claimed in claim 1 and further including the steps of dropping said record-filled sleeve from said first-path position onto a carriage moving along said second path, whereby said carriage moves said record-filled sleeve from above said stack of empty sleeves to a position above said stack of empty jackets, said carriage motion causing entry of said record-filled sleeve into said empty open jacket.

3. A method as claimed in claim 2 and further including the steps of releasing said jacket filled with said record-filled sleeve from said raised position, whereby said filled jacket is supported on said carriage, moving said carriage with said filled jacket from said position above said stack of empty jackets to said position above said stack of filled jackets.

4. A method as claimed in claim 3 and further including the steps of constraining said filled jackets on said carriage at said position above said stack of filled jackets, removing said carriage from said space above said stack of filled jackets and dropping said filled jacket onto said stack of filled jackets.

5. A method as claimed in claim 4, wherein each sleeve has a lower front edge situated forwardly of an upper front edge thereof, and further including the step of preventing the lower front edge of each envelope from moving upwardly with the upper front edge thereof during the raising of each said sleeve from said stack of empty sleeves to the level of said first path to receive a record, so that each sleeve is automatically opened as it is elevated to said first path.

6. A method as claimed in claim 2 and further including the steps of clamping the sleeved and jacketed disc record to said carriage during transport.

7. A method as claimed in claim 6, wherein at least a portion of said carriage enters into said jacket.

8. An apparatus for enclosing disc records in a sleeve, and enclosing said record-filled sleeve in a jacket comprising:

pusher means for engaging and pushing a finished disc record along a first path;
carriage means for transporting sleeved records and sleeved and jacketed records along a second path;
first holding means for releasably holding an empty sleeve on said first path, said disc record being pushed toward said empty sleeve; second holding means for releasably holding an empty jacket on said second path;
means for driving said carriage means along said second path,
whereby said pushed disc record is pushed into said held sleeve, said carriage, when driven, moves to said positions of said releasable holding means, and said record-filled sleeve transported by said carriage means is inserted in said held jacket.

9. An apparatus for enclosing disc records as claimed in claim 8 and further comprising a receiver for a stack of empty sleeves, said stack of empty sleeves being positioned below said first releasable holding means, and a receiver for a stack of empty jackets, said stack of empty jackets being positioned beneath said second releasable holding means.

10. An apparatus for enclosing disc records as claimed in claim 9, wherein said releasable holding means each includes a vacuum head having means for releasably engaging and holding when a vacuum pressure is applied.

11. An apparatus for enclosing disc records as claimed in claim 10 and further comprising means for vertically moving in reciprocal motion said first and second releasable holding means, said first releasable holding means being adapted to descend and to engage and hold by said vacuum head an empty sleeve on said stack of empty sleeves and elevate said engaged empty sleeve, said second releasable holding means being adapted to descend and to engage and hold by said vacuum head an empty jacket on said stack of empty jackets and raise said empty jacket.

12. An apparatus for enclosing disc records as claimed in claim 11 and further comprising control means for timing the operation of said carriage and said holding heads.

13. An apparatus for enclosing disc records as claim in claim 11 and further comprising a receiver for a stack of similar disc records enclosed in similar sleeves and jackets and means for constraining said filled jacket carried by said carriage means from motion along said second path, said constraining means being positioned to constrain said filled jacket over said receiver for said stack of filled jackets, whereby said constrained filled jacket is released from said carriage means when said carriage means moves on said second path away from said receiver for said stack of sleeved and jacketed records.

14. An apparatus for enclosing disc records as claimed in claim 8 and further comprising means for opening said sleeve at said first releasable holding means.

15. An apparatus for enclosing disc record as claimed in claim 14, wherein each said sleeve has a lower front edge situated forwardly of an upper front edge thereof, and further comprising means for preventing the lower front edge of said sleeve from moving upwardly with said upper front edge during the raising of each said sleeve from said stack of empty sleeves, whereby said sleeve is opened.

16. An apparatus for enclosing disc records as claimed in claim 15, wherein said means for preventing includes at least one fixed finger, said at least one finger being located in the path of an up-moving sleeve, said at least one finger engaging said lower front edge.

17. An apparatus for enclosing disc records as claimed in claim 16 and further comprising means for blowing a stream of air into the interior of each raised, open sleeve in order to maintain said open condition for receiving said disc record.

18. An apparatus for enclosing disc records as claimed in claim 8 or 17 and further comprising means at said second releasable holding means for opening the entrance to said jacket in order to receive therein said sleeved disc record on said carriage means.

19. An apparatus for enclosing disc records as claimed in claim 18, wherein said means for opening said jacket includes vacuum means acting on the lower side of said jacket.

20. An apparatus for enclosing disc records as claimed in claim 19, wherein said first path and said second path intersect, and said paths are substantially transverse at said point of intersection.

21. An apparatus for enclosing disc records as claimed in claim 8, wherein said first path and said second path intersect, and said paths are substantially transverse at said point of intersection.

22. An apparatus for enclosing disc records as claimed in claim 20, wherein said first and second paths are substantially straight paths.

23. An apparatus for enclosing disc records as claimed in claim 21, wherein said first and second paths are substantially straight paths.

24. An apparatus for enclosing disc records as claimed in claim 8 or 11 and further comprising clamping means, said clamping means holding said sleeved and jacketed disc records in said carriage during transport along said second path, said sleeved record being clamped during insertion into a jacket and said filled jacket being unclamped when said filled jacket is constrained from moving on said second path by said constraining means.

25. An apparatus for enclosing disc records as claimed in claim 19 and further comprising clamping means, said clamping means holding said sleeved and jacketed disc records in said carriage during transport along said second path, said sleeved record being clamped during insertion into a jacket and said filled jacket being unclamped when said filled jacket is constrained from moving on said second path by said constraining means.

26. An apparatus for enclosing disc records as claimed in claim 13, and further comprising clamping means, said clamping means holding said sleeved and jacketed disc records in said carriage during transport along said second path, said sleeved record being clamped during insertion into a jacket and said filled jacket being unclamped when said filled jacket is constrained from moving on said second path by said constraining means.

27. An apparatus for enclosing disc records as claimed in claim 26, wherein said filled jacket is unclamped when constrained from moving on said second path by said constraining means.

28. An apparatus for enclosing disc records as claimed in claim 9 or 13, wherein said vacuum heads includes suction cups, said suction cups being selectively connected to a vacuum source, said cups engaging said empty sleeve and empty jacket at said first and second releasable holding means, respectively.

29. An apparatus for enclosing disc records as claimed in claim 8, 13, or 23, wherein said pusher means is a portion of an apparatus for the manufacture of disc records.

30. An apparatus for enclosing disc records as claimed in claim 8 or 11, and further comprising means for translating at least a portion of said second releasable holding means along said second path.

31. An apparatus for enclosing disc records as claimed in claim 19, and further comprising means for translating at least a portion of said second releasable holding means along said second path.

32. An apparatus for enclosing disc records as claimed in claim 30, wherein said second releasable holding means when translated brings a supported jacket into registry with vacuum means for opening said supported jacket.

33. An apparatus for enclosing disc records as claimed in claim 31, wherein said second releasable holding means when translated brings a supported jacket into registry with said vacuum means.

34. An apparatus for enclosing disc records as claimed in claim 12, wherein said control means are adapted to cause said carriage to arrive empty at said first releasable holding means to receive a sleeve containing a disc record therein, said record-filled sleeve to be released to said carriage by said first releasable holding means; said first releasable holding means to descend, engage and raise another empty sleeve after said carriage moves away from said first releasable holding means; said carriage to push said sleeved disc record into said jacket at said second releasable holding means; said second releasable holding means to descend, engage and raise another empty jacket after said carriage means moves away from said second releasable holding means; said carriage to transport said filled jacket over said stack of filled jackets, said constraining means to hold said filled jacket during deparature of said carriage toward said first releasable holding means.

* * * * *